US011167297B2

(12) United States Patent
Fritz et al.

(10) Patent No.: US 11,167,297 B2
(45) Date of Patent: Nov. 9, 2021

(54) PRINT HEAD FOR THE APPLICATION OF A COATING AGENT

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE); Frank Herre, Oberriexingen (DE); Steffen Sotzny, Oberstenfeld (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 0 days.

(21) Appl. No.: 16/468,689

(22) PCT Filed: Dec. 1, 2017

(86) PCT No.: PCT/EP2017/081141
§ 371 (c)(1),
(2) Date: Jun. 12, 2019

(87) PCT Pub. No.: WO2018/108576
PCT Pub. Date: Jun. 21, 2018

(65) Prior Publication Data

US 2019/0336990 A1 Nov. 7, 2019

(30) Foreign Application Priority Data

Dec. 14, 2016 (DE) ..... 10 2016 014 947.7

(51) Int. Cl.
*B05B 1/30* (2006.01)
*B05B 1/32* (2006.01)
(Continued)

(52) U.S. Cl.
CPC ..... *B05B 1/3073* (2013.01); *B05B 1/14* (2013.01); *B05B 1/306* (2013.01); *B05B 1/3053* (2013.01);
(Continued)

(58) Field of Classification Search
CPC ..... B05B 1/3073; B05B 1/14; B05B 1/3053; B05B 1/306; B05B 1/32; B05B 13/0452;
(Continued)

(56) References Cited

U.S. PATENT DOCUMENTS 3,421,694 A 1/1969 Muller
3,717,306 A 2/1973 Hushon et al.
(Continued)

FOREIGN PATENT DOCUMENTS

CN 2287527 Y 8/1998
CN 1331661 A 1/2002
(Continued)

OTHER PUBLICATIONS

Ghasem, G. et al; "Chapter 2 Background on Sprays and Their Production", Industrial Sprays and Atomization: Design, Analysis and Applications, Jan. 1, 2002, Springer, London, pp. 7-33, XP009195118, ISBN: 978-1-4471-3816-7.
(Continued)

*Primary Examiner* — Laura Edwards
(74) *Attorney, Agent, or Firm* — Bejin Bieneman PLC

(57) ABSTRACT

The disclosure relates to a print head for applying a coating agent to a component, in particular for applying a paint to a motor vehicle body component, having a nozzle plate, a nozzle in the nozzle plate for dispensing the coating agent, and a valve element movable relative to the nozzle plate for controlling the release of coating agent through the nozzle, the movable valve element closing the nozzle in a closed position, whereas the movable valve element releases the
(Continued)

nozzle in an opened position, and having a seal for sealing the nozzle with respect to the movable valve element in the closed position of the valve element. The disclosure provides that the seal is not designed as an elastomer insert on the valve element.

25 Claims, 8 Drawing Sheets

(51) Int. Cl.
*B05B 13/04* (2006.01)
*B05C 5/02* (2006.01)
*B05C 11/10* (2006.01)
*B05B 1/14* (2006.01)

(52) U.S. Cl.
CPC ..... *B05B 1/32* (2013.01); *B05B 13/0452* (2013.01); *B05C 5/0237* (2013.01); *B05C 5/0275* (2013.01); *B05C 5/0291* (2013.01); *B05C 11/1028* (2013.01); *B41J 2202/05* (2013.01)

(58) Field of Classification Search
CPC ..... B05B 1/3046; B41J 2202/05; B41J 2/14; B05C 5/0208; B05C 5/0237; B05C 5/0283; B05C 5/0291; B05C 5/0275; B05C 11/1028
USPC ..... 118/313
See application file for complete search history.

(56) References Cited

U.S. PATENT DOCUMENTS 3,981,320 A 9/1976 Wiggins
4,141,231 A 2/1979 Kudlich
4,375,865 A 3/1983 Springer
4,383,264 A * 5/1983 Lewis ..... B41J 2/14201 347/47
4,423,999 A 1/1984 Choly
4,430,010 A 2/1984 Zrenner et al.
4,435,719 A 3/1984 Snaper
4,478,241 A 10/1984 Cardenas-Franco
4,555,719 A 11/1985 Arway et al.
4,668,948 A 5/1987 Merkel
4,734,711 A 3/1988 Piatt et al.
4,826,135 A 5/1989 Mielke
4,894,252 A 1/1990 Bongen et al.
4,941,778 A 7/1990 Lehmann
4,974,780 A 12/1990 Nakamura et al.
4,985,715 A 1/1991 Cyphert et al.
5,050,533 A 9/1991 Zaber
5,072,881 A 12/1991 Taube, III
5,429,682 A 7/1995 Harlow, Jr. et al.
5,435,884 A 7/1995 Simmons et al.
5,538,221 A 7/1996 Joswig
5,556,466 A 9/1996 Martin et al.
5,602,575 A 2/1997 Pauly
5,636,795 A 6/1997 Sedgwick et al.
5,647,542 A 7/1997 Diana
5,659,347 A 8/1997 Taylor
5,681,619 A 10/1997 Ogasawara
5,740,967 A 4/1998 Simmons et al.
5,843,515 A 12/1998 Crum et al.
5,951,882 A 9/1999 Simmons et al.
5,964,407 A 10/1999 Sandkleiva
5,976,343 A 11/1999 Schlaak
6,179,217 B1 1/2001 Yoshida et al.
6,540,835 B2 4/2003 Kim et al.
6,607,145 B1 8/2003 Boriani et al.
6,641,667 B2 11/2003 Ochiai et al.
6,712,285 B2 3/2004 Provenaz et al.
6,777,032 B2 8/2004 Ogasahara et al.
6,811,807 B1 11/2004 Zimmermann et al.
6,849,684 B2 2/2005 Poppe et al.
7,160,105 B2 1/2007 Edwards
7,178,742 B2 2/2007 Nellentine et al.
7,182,815 B2 2/2007 Katagami et al.
7,244,310 B2 7/2007 Edwards
7,270,712 B2 9/2007 Edwards
7,357,959 B2 4/2008 Bauer
7,387,071 B2 6/2008 Heinke et al.
7,449,070 B2 11/2008 Fellingham
7,604,333 B2 10/2009 Horsnell
7,757,632 B2 7/2010 Edwards
7,837,071 B2 11/2010 Achrainer
7,901,741 B2 3/2011 Katagami et al.
8,028,651 B2 10/2011 Rademacher et al.
8,118,385 B2 2/2012 Van De Wynckel et al.
8,449,087 B2 5/2013 Kataoka et al.
8,545,943 B2 10/2013 Frankenberger et al.
8,652,581 B2 2/2014 Merchant
8,678,535 B2 3/2014 Beier et al.
8,875,655 B2 11/2014 Pettersson et al.
8,882,242 B2 11/2014 Beier et al.
9,108,424 B2 8/2015 Wallsten et al.
9,140,247 B2 9/2015 Herre et al.
9,156,054 B2 10/2015 Ikushima
9,266,353 B2 2/2016 Beier et al.
9,393,787 B2 7/2016 Ikushima
9,464,573 B2 10/2016 Remy et al.
9,592,524 B2 3/2017 Fritz et al.
9,701,143 B2 7/2017 Ikushima
9,707,585 B2 7/2017 Reimert et al.
9,844,792 B2 12/2017 Pettersson et al.
9,901,945 B2 2/2018 Fehr et al.
9,914,150 B2 3/2018 Pettersson et al.
10,016,977 B2 7/2018 Stefani et al.
10,105,946 B2 10/2018 Nakamura et al.
10,150,304 B2 12/2018 Herre et al.
10,252,552 B2 4/2019 Pitz et al.
10,272,677 B2 4/2019 Stefani et al.
10,532,569 B2 1/2020 Wallsten et al.
2001/0017085 A1 8/2001 Kubo et al.
2001/0019340 A1 9/2001 Kubo et al.
2002/0024544 A1 2/2002 Codos
2002/0043280 A1 4/2002 Ochiai et al.
2002/0043567 A1 4/2002 Provenaz et al.
2002/0105688 A1 8/2002 Katagami et al.
2002/0128371 A1 9/2002 Poppe et al.
2003/0020783 A1 1/2003 Sanada
2003/0041884 A1 3/2003 Bahr
2003/0049383 A1 3/2003 Ogasahara et al.
2004/0028830 A1 2/2004 Bauer
2004/0089234 A1 5/2004 Hagglund et al.
2004/0123159 A1 6/2004 Kerstens
2004/0173144 A1 9/2004 Edwards
2004/0221804 A1 11/2004 Zimmermann et al.
2004/0231594 A1 11/2004 Edwards
2004/0238522 A1 12/2004 Edwards
2004/0256501 A1 12/2004 Mellentine et al.
2004/0261700 A1 12/2004 Edwards
2005/0000422 A1 1/2005 Edwards
2005/0015050 A1 1/2005 Mowery et al.
2005/0016451 A1 1/2005 Edwards
2005/0023367 A1 2/2005 Reighard et al.
2005/0243112 A1 11/2005 Kobayashi et al.
2006/0061613 A1 3/2006 Fienup et al.
2006/0068109 A1 3/2006 Frankenberger et al.
2006/0146379 A1 7/2006 Katagami et al.
2006/0238587 A1 10/2006 Horsnell
2006/0251796 A1 11/2006 Fellingham
2007/0062383 A1 3/2007 Gazeau
2007/0292626 A1 12/2007 Larsson et al.
2008/0271674 A1 11/2008 Rademacher
2008/0309698 A1 12/2008 Nakano et al.
2009/0027433 A1 1/2009 Van De Wynckel et al.
2009/0029069 A1 1/2009 Edwards
2009/0181182 A1 7/2009 Sloan
2010/0132612 A1 6/2010 Achrainer
2010/0156970 A1 6/2010 Ikushima
2010/0170918 A1 7/2010 Achrainer
2010/0279013 A1 11/2010 Frankenberger et al.

(56) References Cited

U.S. PATENT DOCUMENTS

| | | | |
|---|---|---|---|
| 2010/0282283 | A1 | 11/2010 | Bauer |
| 2010/0321448 | A1 | 12/2010 | Buestgens et al. |
| 2011/0014371 | A1 | 1/2011 | Herre et al. |
| 2011/0084150 | A1 | 4/2011 | Merchant |
| 2011/0248046 | A1 | 10/2011 | Simion |
| 2011/0262622 | A1 | 10/2011 | Herre |
| 2012/0085842 | A1* | 4/2012 | Ciardella ..... B05C 11/1034 239/583 |
| 2012/0105522 | A1 | 5/2012 | Wallsten |
| 2012/0114849 | A1 | 5/2012 | Melcher |
| 2012/0162331 | A1 | 6/2012 | Kataoka |
| 2012/0186518 | A1 | 7/2012 | Herre |
| 2012/0219699 | A1 | 8/2012 | Pettersson et al. |
| 2012/0249679 | A1 | 10/2012 | Beier et al. |
| 2012/0282405 | A1 | 11/2012 | Herre |
| 2013/0201243 | A1 | 8/2013 | Yoshida |
| 2013/0215203 | A1 | 8/2013 | Chen |
| 2013/0257984 | A1 | 10/2013 | Beier et al. |
| 2013/0284833 | A1 | 10/2013 | Fritz et al. |
| 2014/0076985 | A1 | 3/2014 | Pettersson et al. |
| 2014/0242285 | A1 | 8/2014 | Pettersson et al. |
| 2015/0009254 | A1 | 1/2015 | Kaiba et al. |
| 2015/0042716 | A1 | 2/2015 | Beier et al. |
| 2015/0086723 | A1 | 3/2015 | Bustgens |
| 2015/0098028 | A1 | 4/2015 | Ohnishi |
| 2015/0328654 | A1 | 11/2015 | Schwab |
| 2015/0375258 | A1 | 12/2015 | Fritz et al. |
| 2015/0375507 | A1 | 12/2015 | Ikushima |
| 2016/0052312 | A1 | 2/2016 | Pitz et al. |
| 2016/0074822 | A1 | 3/2016 | Han |
| 2016/0288552 | A1 | 10/2016 | Ikushima |
| 2016/0306364 | A1 | 10/2016 | Ikushima et al. |
| 2017/0087837 | A1 | 3/2017 | Stefani et al. |
| 2017/0106393 | A1 | 4/2017 | Hampson et al. |
| 2017/0136481 | A1 | 5/2017 | Fritz et al. |
| 2017/0252765 | A1 | 9/2017 | Medard |
| 2017/0267002 | A1 | 9/2017 | Pitz et al. |
| 2017/0299088 | A1 | 10/2017 | Rau |
| 2017/0361346 | A1 | 12/2017 | Lahidjanian et al. |
| 2018/0022105 | A1 | 1/2018 | Nakamura et al. |
| 2018/0056670 | A1 | 3/2018 | Kerr |
| 2018/0093491 | A1 | 4/2018 | Murayama et al. |
| 2018/0178505 | A1 | 6/2018 | Stefani et al. |
| 2018/0222186 | A1 | 8/2018 | Stefani et al. |
| 2018/0250955 | A1 | 9/2018 | Herre |
| 2019/0091712 | A1 | 3/2019 | Medard et al. |

FOREIGN PATENT DOCUMENTS

| | | | |
|---|---|---|---|
| CN | 1438942 | A | 8/2003 |
| CN | 1512919 | A | 7/2004 |
| CN | 1176815 | C | 11/2004 |
| CN | 1668386 | A | 9/2005 |
| CN | 1761530 | A | 4/2006 |
| CN | 101264698 | A | 9/2008 |
| CN | 101309755 | A | 11/2008 |
| CN | 101657264 | A | 2/2010 |
| CN | 101784348 | A | 7/2010 |
| CN | 102177002 | A | 9/2011 |
| CN | 102198434 | A | 9/2011 |
| CN | 102971080 | A | 3/2013 |
| CN | 103153483 | A | 6/2013 |
| CN | 103909743 | A | 7/2014 |
| CN | 104613205 | A | 5/2015 |
| CN | 104994966 | A | 10/2015 |
| CN | 105358259 | A | 2/2016 |
| CN | 106414081 | A | 2/2017 |
| DE | 1284250 | A | 11/1968 |
| DE | 7710895 | U1 | 9/1977 |
| DE | 3045401 | A1 | 7/1982 |
| DE | 3221327 | A1 | 9/1983 |
| DE | 3225554 | A1 | 1/1984 |
| DE | 3634747 | A1 | 8/1987 |
| DE | 3804092 | A1 | 9/1988 |
| DE | 4115111 | A1 | 11/1991 |
| DE | 4138491 | A1 | 5/1993 |
| DE | 9405600 | U1 | 6/1994 |
| DE | 68924202 | T2 | 2/1996 |
| DE | 19606716 | C1 | 8/1997 |
| DE | 19630290 | A1 | 1/1998 |
| DE | 19731829 | A1 | 1/1999 |
| DE | 19743804 | A1 | 4/1999 |
| DE | 9422327 | U1 | 3/2000 |
| DE | 19852079 | A1 | 5/2000 |
| DE | 19936790 | A1 | 2/2001 |
| DE | 20017629 | U1 | 3/2001 |
| DE | 10048749 | A1 | 4/2002 |
| DE | 69429354 | T2 | 5/2002 |
| DE | 69622407 | T2 | 3/2003 |
| DE | 10307719 | A1 | 9/2003 |
| DE | 60001898 | T2 | 2/2004 |
| DE | 102004021223 | A1 | 12/2004 |
| DE | 10331206 | A1 | 1/2005 |
| DE | 102004034270 | A1 | 2/2006 |
| DE | 102004044655 | A1 | 3/2006 |
| DE | 102004049471 | A1 | 4/2006 |
| DE | 60212523 | T2 | 2/2007 |
| DE | 69836128 | T2 | 8/2007 |
| DE | 60125369 | T2 | 10/2007 |
| DE | 102006021623 | A1 | 11/2007 |
| DE | 102006056051 | A1 | 5/2008 |
| DE | 102007018877 | A1 | 10/2008 |
| DE | 102007037663 | A1 | 2/2009 |
| DE | 10 2008 018 881 | A1 | 9/2009 |
| DE | 102008053178 | A1 | 5/2010 |
| DE | 102009029946 | A1 | 12/2010 |
| DE | 102009038462 | A1 | 3/2011 |
| DE | 102010004496 | A1 | 7/2011 |
| DE | 102010019612 | A1 | 11/2011 |
| DE | 102012006371 | A1 | 7/2012 |
| DE | 102012005087 | A1 | 10/2012 |
| DE | 102012005650 | A1 | 9/2013 |
| DE | 102012212469 | A | 1/2014 |
| DE | 102012109123 | A1 | 3/2014 |
| DE | 202013101134 | U1 | 6/2014 |
| DE | 102013002412 | A1 | 8/2014 |
| DE | 102013011107 | A1 | 8/2014 |
| DE | 102013205171 | A1 | 9/2014 |
| DE | 102014006991 | A1 | 12/2014 |
| DE | 102014007523 | A1 | 11/2015 |
| DE | 102014008183 | A1 | 12/2015 |
| DE | 102014012705 | A1 | 3/2016 |
| DE | 102014013158 | | 3/2016 |
| EP | 0138322 | A1 | 4/1985 |
| EP | 0297309 | A2 | 1/1989 |
| EP | 0665106 | A2 | 8/1995 |
| EP | 1120258 | A2 | 8/2001 |
| EP | 1764226 | A1 | 3/2007 |
| EP | 1852733 | A1 | 11/2007 |
| EP | 1884365 | A1 | 2/2008 |
| EP | 1946846 | A2 | 7/2008 |
| EP | 2002898 | A1 | 12/2008 |
| EP | 2133154 | A2 | 12/2009 |
| EP | 2151282 | A1 | 2/2010 |
| EP | 2196267 | A2 | 6/2010 |
| EP | 2380744 | A2 | 10/2011 |
| EP | 2433716 | A1 | 3/2012 |
| EP | 2468512 | A1 | 6/2012 |
| EP | 2641661 | A1 | 9/2013 |
| EP | 2644392 | A2 | 10/2013 |
| EP | 2777938 | A1 | 9/2014 |
| EP | 2799150 | A1 | 11/2014 |
| EP | 2842753 | A1 | 3/2015 |
| EP | 3002128 | A2 | 4/2016 |
| EP | 3156138 | A1 | 4/2017 |
| EP | 3213823 | A1 | 9/2017 |
| EP | 3257590 | A1 | 12/2017 |
| EP | 3272669 | A1 | 1/2018 |
| EP | 3068626 | B1 | 10/2019 |
| FR | 3010918 | A1 | 3/2015 |
| GB | 2200433 | A | 8/1988 |
| GB | 2367771 | A | 4/2002 |
| GB | 2507069 | A | 4/2014 |

(56) References Cited

FOREIGN PATENT DOCUMENTS

| | | | |
|---|---|---|---|
| JP | S5722070 | A | 2/1982 |
| JP | S62116442 | A | 5/1987 |
| JP | H04-106669 | U | 9/1992 |
| JP | H0798171 | B2 | 10/1995 |
| JP | H09192583 | A | 7/1997 |
| JP | 2000158670 | A | 6/2000 |
| JP | 2000317354 | A | 11/2000 |
| JP | 2001129456 | A | 5/2001 |
| JP | 2001157863 | A | 6/2001 |
| JP | 2001239652 | A | 9/2001 |
| JP | 2001300404 | A | 10/2001 |
| JP | 2002361863 | A | 12/2002 |
| JP | 2003506210 | A | 2/2003 |
| JP | 2003136030 | A | 5/2003 |
| JP | 2004142382 | A | 5/2004 |
| JP | 2005526234 | A | 9/2005 |
| JP | 2007021760 | A | 2/2007 |
| JP | 2007152666 | A | 6/2007 |
| JP | 2007520340 | A | 7/2007 |
| JP | 2007245633 | A | 9/2007 |
| JP | 2007289848 | A | 11/2007 |
| JP | 2010531213 | A | 9/2010 |
| JP | 2010531729 | A | 9/2010 |
| JP | 2010241003 | A | 10/2010 |
| JP | 2011206958 | A | 10/2011 |
| JP | 2012506305 | A | 3/2012 |
| JP | 2012135925 | A | 7/2012 |
| JP | 2012206116 | A | 10/2012 |
| JP | 2012228643 | A | 11/2012 |
| JP | 2012228660 | | 11/2012 |
| JP | 2013067179 | A | 4/2013 |
| JP | 2013530816 | A | 8/2013 |
| JP | 2013530816 | B2 | 8/2013 |
| JP | 2013188706 | A | 9/2013 |
| JP | 2014019140 | A | 2/2014 |
| JP | 2014050832 | A | 3/2014 |
| JP | 2014111307 | A | 6/2014 |
| JP | 2015-009222 | A | 1/2015 |
| JP | 2015096322 | A | 5/2015 |
| JP | 2015520011 | A | 7/2015 |
| JP | 2015193129 | A | 11/2015 |
| JP | 2016507372 | A | 3/2016 |
| JP | 2016526910 | A | 9/2016 |
| JP | 2016175077 | A | 10/2016 |
| JP | 2016175662 | A | 10/2016 |
| JP | 2018012065 | A | 1/2018 |
| JP | 2020513311 | A | 5/2020 |
| JP | 2020513314 | A | 5/2020 |
| WO | 8601775 | A1 | 3/1986 |
| WO | 9856585 | A1 | 12/1998 |
| WO | 02098576 | A1 | 12/2002 |
| WO | 03021519 | A1 | 3/2003 |
| WO | 2003062129 | A2 | 7/2003 |
| WO | 2004048112 | A1 | 6/2004 |
| WO | 2004085738 | A2 | 10/2004 |
| WO | 2005016556 | A1 | 2/2005 |
| WO | 2005075170 | A1 | 8/2005 |
| WO | 2006022217 | A1 | 3/2006 |
| WO | 2007121905 | A1 | 11/2007 |
| WO | 2009019036 | A1 | 2/2009 |
| WO | 2010046064 | A1 | 4/2010 |
| WO | 2010146473 | A1 | 12/2010 |
| WO | 2011044491 | A1 | 4/2011 |
| WO | 2011128439 | A1 | 10/2011 |
| WO | 2011138048 | A1 | 11/2011 |
| WO | 2013121565 | A1 | 8/2013 |
| WO | 2015071270 | A1 | 5/2015 |
| WO | 2015096322 | A1 | 7/2015 |
| WO | 2015186014 | A1 | 12/2015 |
| WO | 2016-087016 | A1 | 6/2016 |
| WO | 2016142510 | A1 | 9/2016 |
| WO | 2016145000 | A1 | 9/2016 |
| WO | 2017006245 | A1 | 1/2017 |
| WO | 2017006246 | A1 | 1/2017 |
| WO | 2018102846 | A1 | 6/2018 |

OTHER PUBLICATIONS

International Search Report and Written Opinion for PCT/EP2017/081141 dated Feb. 26, 2018 (17 pages; with English translation).
International Search Report and Written Opinion for PCT/EP2017/081114 dated May 15, 2018 (33 pages; with English translation).
Anonymous: "Roboterkalibrierung—Wikipedia", Nov. 7, 2016, XP055471615, Gefunden im Internet: URL: https://de.wikipedia.org/w/index.php?title=Roboterkalibrierung&oldid=159460756 [gefunden am Apr. 30, 2018] das ganze dockument (8 pages; with English translation).
Beyer, Lukas: "Genauigkeitssteigerung von Industrierobotern", Forschungsberichte Aus Dem Laboratorium Fertigungstechnik/Helmut-Schmidt-Universitat, Universitat Der Bundeswehr Hamburg, Dec. 31, 2005, Seiten 1-4, XP009505118; ISSN: 1860-2886; ISBN: 978-3-8322-3681-6 (13 pages; with English machine translation).
International Search Report and Written Opinion for PCT/EP2017/081108 dated Feb. 28, 2018 (with English translation; 18 pages).
International Search Report and Written Opinion for PCT/EP2017/081099 dated Feb. 26, 2018 (21 pages; with English translation).
International Search Report and Written Opinion for PCT/EP2017/081102 dated Mar. 14, 2018 (16 pages; with English translation).
International Search Report and Written Opinion for PCT/EP2017/081105 dated Feb. 26, 2018 (19 pages; with English translation).
International Search Report and Written Opinion for PCT/EP2017/081152 dated May 15, 2018 (25 pages; with English translation).
International Search Report and Written Opinion for PCT/EP2017/081098 dated May 14, 2018 (26 pages; with English translation).
International Search Report and Written Opinion for PCT/EP2017/081101 dated Feb. 28, 2018 (14 pages; with English translation).
International Search Report and Written Opinion for PCT/EP2017/081121 dated Feb. 26, 2018 (20 pages; with English translation).
International Search Report and Written Opinion for PCT/EP2017/081117 dated Mar. 12, 2018 (27 pages; with English translation).
International Search Report and Written Opinion for PCT/EP2017/081123 dated Feb. 26, 2018 (20 pages; with English translation).
European Search Report for EP20170638.9 dated Sep. 14, 2020 (4 pages—English translation not available).
European Search Report for EP20170021.8 dated Sep. 8, 2020 (11 pages—English translation not available).
European Search Report for EP20170025.9 dated Sep. 9, 2020 (4 pages—English translation not available).
European Search Report for EP20170016.8 dated Sep. 7, 2020 (4 pages—English translation not available).
China National Intellectual Property Administration Office Action and Search Report for CN Application No. 201780077018.3 dated Aug. 27, 2020 (11 pages; Search Report in English).
Chinese Office Action and Search Report for CN201780077603.3 dated Oct. 12, 2020 (15 pages; English translation not available).
EPO Official Notification of Opposition for Application No. 17821803.8 dated Feb. 10, 2021 (64 pages; with English machine translation).
Non-Final Office Action dated Feb. 5, 2021 for U.S. Appl. No. 16/468,701 (80 pages).
Non-Final Office Action dated Feb. 18, 2021 for U.S. Appl. No. 16/468,692 (97 pages).
JPO Submission for JP2019-531096; submitted Dec. 21, 2020 (32 pages; with English translation).
JPO Submission for JP2019-531957; submitted Dec. 21, 2020 (21 pages; with English translation).
Chinese Office Action for Application No. CN20178007017.9 dated Aug. 31, 2020 (8 pages; with English translation).
Non Final Office Action for U.S. Appl. No. 16/468,697 dated Oct. 22, 2020 (78 pages).
Non Final Office Action for U.S. Appl. No. 16/468,696 dated Nov. 2, 2020 (58 pages).
Non Final Office Action for U.S. Appl. No. 16/468,700 dated Dec. 1, 2020 (73 pages).
Chinese Office Action for CN201780077476.7 dated Sep. 23, 2020 (12 pages; English translation not available).
Non-Final Office Action for U.S. Appl. No. 16/468,691 dated Jan. 7, 2021 (79 pages).

(56) References Cited

OTHER PUBLICATIONS

EPO Examination Report for Application No. 201702818.1 dated Dec. 18, 2020 (with English machine translation; 6 pages).
Non-Final Office Action dated Apr. 28, 2021 for U.S. Appl. No. 16/468,693 (109 pages).
Final Office Action dated Apr. 19, 2021 for U.S. Appl. No. 16/468,700 (62 pages).
Fianl Office Action dated May 13, 2021 for U.S. Appl. No. 16/468,691 (70 pages).
Final Office Action dated Mar. 19, 2021 for U.S. Appl. No. 16/468,696 (45 pages).
Final Office Action dated Jun. 11, 2021 for U.S. Appl. No. 16/468,701 (53 pages).
JPO Notification of Reasons for Rejection for Application No. JP2019-532030 dated May 18, 2021 (6 pages; with English translation).
CIPO Office Action for Application No. CN2017800//474.8 dated Apr. 26, 2021 (17 pages; with English translation).
Chinese Office Action dated Jun. 2, 2021 for Application No. CN201780077017.9 (17 pages; with English machine translation).
Japanese Notification of Reasons for Rejection dated Jun. 1, 2021 for Application No. JP2019-531944 (14 pages with English machine translation).
Japanese Notification of Reasons for Rejection dated Jun. 8, 2021 for Application No. JP2019-531957 (13 pages with English machine translation).
Supplemental Notice of Allowability dated Jul. 8, 2021 for U.S. Appl. No. 16/468,696 (11 pages).
Liptak, Bela. (2006). Instrument Engineers' Handbook (4th Edition)—Process Control and Optimization, vol. 2—2.1.3.5 Process Time Constant, (pp. 99-102). Taylor & Francis. Retrieved from https://app.knovel.eom/hotlink/pdf/id:kt00CC7HL1/instrument-engineers/process-time-constant (Year: 2006).
Japenese Patent Office Notice of Reasons of Refusal for Application No. JP 2019-531967 dated Jun. 8, 2021 (8 pages; with English machine translation).
Notification of Reasons for Refusal for Application No. JP2019-532012 dated Jun. 22, 2021 (6 pages; with English machine translation).
Notification of Reasons for Refusal for Application No. JP2019-527330 dated Jun. 22, 2021 (10 pages; with English machine translation).
JPO Office Action for Application No. JP2019-531097 dated Jun. 29, 2021 (10 pages; with English machine translation).
JPO Office Action for Application No. 2019-531096 dated Jul. 6, 2021 (9 pages; with English machine translation).
JPO Office Action for Application No. 2019-531098 dated Jul. 6, 2021 (5 pages; English translation only).
JPO Office Action for Application No. 2019-531459 dated Jul. 6, 2021 (8 pages; with English machine translation).
JPO Office Action dated Jul. 3, 2021 for Application No. JP2019-532024 (12 pages; with English machine translation).
Non-Final Office Action dated Aug. 27, 2021 for U.S. Appl. No. 16/468,695 (149 pages).

* cited by examiner

PRINT HEAD FOR THE APPLICATION OF A COATING AGENT

CROSS-REFERENCE TO RELATED APPLICATIONS

This application is a national stage of, and claims priority to, Patent Cooperation Treaty Application No. PCT/EP2017/081141, filed on Dec. 1, 2017, which application claims priority to German Application No. DE 10 2016 014 947.7, filed on Dec. 14, 2016, which applications are hereby incorporated herein by reference in their entireties.

The disclosure concerns a print head for the application of a coating agent to a component, in particular for the application of a paint to a vehicle body component.

Rotary atomizers are usually used as application devices for the series painting of vehicle body components, but these have the disadvantage of limited application efficiency, i.e. only part of the applied paint deposits on the components to be coated, while the rest of the applied paint has to be disposed of as so-called overspray.

A newer development line, on the other hand, provides for so-called print heads as application devices, as known for example from DE 10 2013 002 412 A1, U.S. Pat. No. 9,108,424 B2 and DE 10 2010 019 612 A1. In contrast to the known rotary atomizers, such print heads do not emit a spray of the paint to be applied, but rather a paint jet that is spatially narrowly confined and which is almost completely deposited on the component to be painted, so that virtually no overspray occurs.

In this case, numerous nozzles are usually arranged in a nozzle plate of the print head, whereby the individual nozzles can each be opened or closed by a movable valve element. The movable valve element is usually a valve needle with an elastomer insert as seal. Here the valve needle with the elastomer insert can be moved between a closed position and an opened position, whereby the elastomer insert seals the nozzle in the closed position of the valve needle, whereas the elastomer insert is lifted off the nozzle in the opened position and thereby releases the fluid flow (usually ink according to the state of the art) through the nozzle.

A disadvantage of this well-known type of sealing between the movable valve element (e.g. valve needle) and the nozzle is first of all the complex manufacturing process involved in manufacturing the elastomer insert.

Another disadvantage is that the valve needle with the elastomer insert can only be miniaturized within certain limits, so that the nozzle spacing between the adjacent nozzles cannot fall below a lower limit.

Furthermore, the manufacturing precision of the elastomer insert is limited, so that large fluctuations occur with regard to the required valve stroke.

The technical background of the disclosure can also be found in DE 36 34 747 A1, DE 10 2014 012 705 A1, DE 41 38 491 A1.

DETAILED DESCRIPTION

Figure 1:
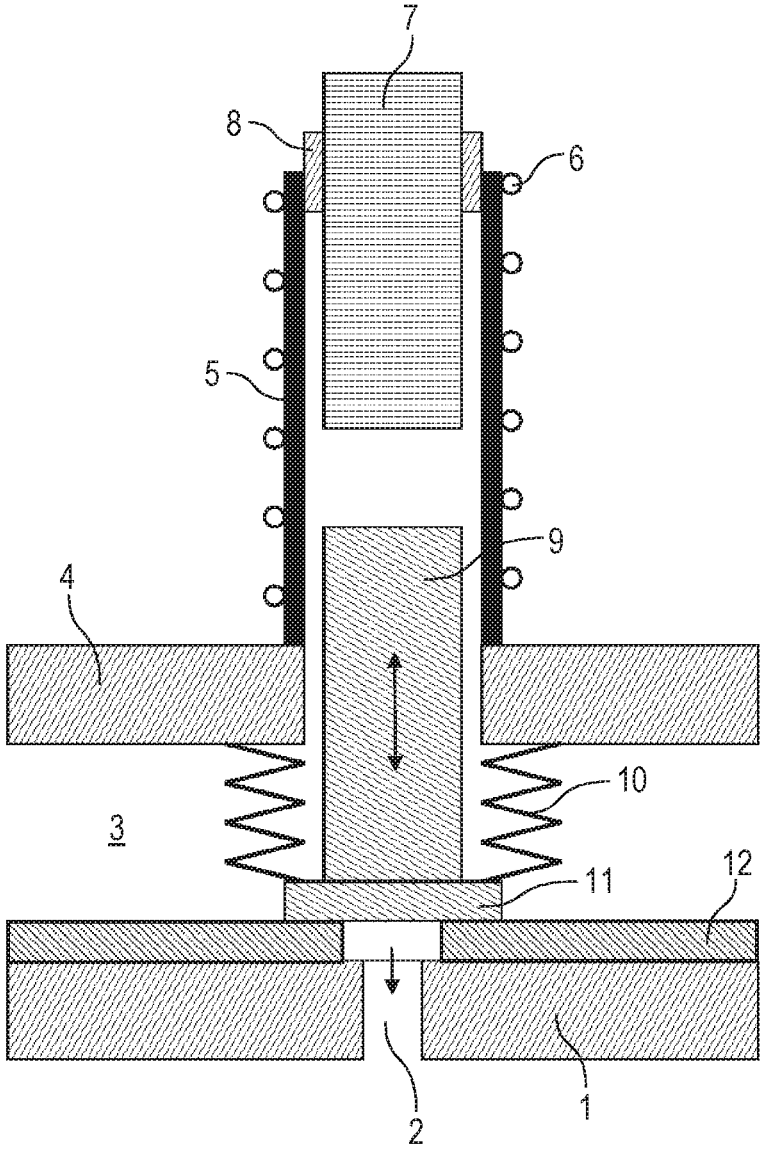
FIG. 1 a schematic representation of a cut-out from an print head according to the disclosure with a flat seal, FIG. 2 a modification of FIG. 1 with a shape-fit of nozzle and valve element, FIG. 3 a modification of FIGS. 1 and 2 with a flexible diaphragm as seal, FIG. 4 another variation with an additional actuator diaphragm hydraulically driven, FIG. 5 a further variation with a tappet which is movable and moves a valve plate in a nozzle channel.

The term "print head" used in the context of the disclosure is to be understood in general and only serves to distinguish from atomizers (e.g. rotary atomizers, disc atomizers, airless atomizers, air-mix atomizers, ultrasonic atomizers) that emit a spray of the coating agents to be applied. In contrast, the print head according to the disclosure emits a spatially limited jet of coating agent. Such print heads are known from the state of the art and are described for example in DE 10 2013 092 412 A1, U.S. Pat. No. 9,108,424 B2 and DE 10 2010 019 612 A1.

It should also be mentioned that the print head according to the disclosure is preferably used for the application of a paint (e.g. base coat, clear coat, water paint, solvent-based paint). However, the print head according to the disclosure can alternatively be designed for the application of other coating agents, such as sealants, insulating materials, adhesives, primers, etc., to name just a few examples.

In accordance with the state of the art, the print head according to the disclosure has a nozzle plate which contains at least one nozzle for dispensing the coating agent. Preferably, this nozzle emits the aforementioned coating agent jet onto the component to be coated. There is, however, also the possibility that the nozzle is arranged inside the print head and only passes the coating agent on to the outer outlet nozzle, which then applies the coating agent jet to the component.

In addition, in accordance with the state of the art, the print head according to the disclosure has a valve element that controls the release of coating agent through the nozzle. This valve element is movable relative to the nozzle plate, with the valve element closing the nozzle in a closed position, whereas the movable valve element releases the nozzle in an opened position.

Preferably, the movement of the valve element between the closed position and the opened position is a linear movement (displacement movement), however, within the scope of the disclosure there is basically also the possibility of other movements of the valve element between the opened position and the closed position. A rotary movement, a swivel movement or a combined rotary and linear movement of the valve element are just a few examples.

Furthermore, the print head according to the disclosure includes a seal to seal the nozzle against the movable valve element in the closed position of the valve element.

However, in the case of the print head according to the disclosure, this seal is preferably not designed as an elastomer insert on the valve element, as this is associated with the problems described above.

For example, the seal can be arranged on the nozzle plate, i.e. not on the movable valve element, as is the case with the known elastomer inserts. Alternatively, it is also possible that the seal according to the disclosure is attached to the movable valve element, i.e. not to the nozzle plate. In addition, it is also possible to combine these two alternatives, whereby a seal is attached to both the movable valve element and the nozzle plate, in this case the nozzle, and the two seals then interact.

It should also be mentioned that the seal is preferably flat and, in the closed position, creates a flat contact between the moving valve element and the seal. For example, flat sealing plates or sealing layers can be applied to the inside of the nozzle plate for this purpose.

Furthermore, in an embodiment of the disclosure, there is the possibility that the shape of the movable valve element is complementary to the shape of the nozzle and projects into the nozzle in the closed position. For example, the nozzle can narrow conically in the direction of flow. The movable valve element should then also taper conically towards its free end, preferably with the same cone angle as the nozzle, so that the valve element and the nozzle then form a corresponding form fit, which improves the sealing effect. Alternatively, it is also possible, for example, for the nozzle to have a hemispherical inner contour, so that preferably the movable valve element also has a hemispherical outer contour.

It should also be mentioned that the seal can be applied to the inner flanks of the nozzle. If the inner contour of the nozzle is tapered, the seal will preferably cover the inner flanks of the nozzle.

In another embodiment of the disclosure, the print head has a flexible sealing diaphragm, whereby the flexible sealing diaphragm forms the movable valve element and closes the nozzle in its closed position and releases it in its opened position. This sealing diaphragm is deflected by a valve actuator between the closed position and the opened position. On the one hand, the flexible sealing diaphragm thus seals the nozzle in the closed position. On the other hand, the sealing diaphragm also separates the coating agent supply from the valve actuator so that the valve actuator does not come into contact with the coating agent. This is particularly advantageous when coating agents of different colours are to be applied one after the other and the print head must therefore be rinsed with a flushing agent. The flexible sealing diaphragm prevents coating deposits in the valve actuator and, due to its smooth surface, also allows good flushing properties.

In addition, the sealing diaphragm can also be elastic and then performs the function of a return spring, which pushes the sealing diaphragm into its rest position, in particular into the closed position. The valve actuator then preferably deflects the sealing diaphragm into the opened position, whereas the sealing diaphragm is pressed into the closed position without being actuated by the valve actuator due to its spring elasticity. However, within the scope of the disclosure, there is also the possibility that the sealing diaphragm may be pressed into the opened position due to its spring elasticity, whereby the valve actuator then presses the sealing diaphragm into the closed position.

To move the movable valve drive, the print head preferably has a valve drive. In an example of this disclosure, the valve drive comprises a flexible drive diaphragm which is mechanically coupled to the movable valve element and can be supplied with a drive fluid (e.g. hydraulic fluid, compressed air) in order to deflect the drive diaphragm and thereby move the valve element.

There is also the possibility that the actuator membrane can be acted upon by the coating agent itself. Alternatively, the drive fluid can consist of a part of the paint, e.g. binder, solvent, Mesamol™ or similar. If the diaphragm breaks, this would not be a chemical reaction or incompatibility.

This variant of the valve actuator is particularly advantageous in combination with the flexible sealing diaphragm mentioned above, as there are then two seals between the nozzle and the actuator fluid, one being the seal through the actuator diaphragm and the other the seal through the flexible sealing diaphragm. In this way, leakage of the actuator fluid (e.g. hydraulic fluid) through the nozzle can be prevented with double safety.

Within the scope of the disclosure, however, other designs of the valve drive are also possible. For example, the valve drive can be designed as a solenoid actuator with a coil and a movable armature in the coil, whereby the armature is mechanically coupled to the movable valve element and is shifted between the opened position and the closed position depending on the current supplied to the coil.

In an embodiment of the disclosure, the valve element (e.g. tappet) is fixed in the print head, while the nozzle plate is elastically flexible and can be bent by the valve actuator. In the closed position, the valve drive then preferably exerts no force on the nozzle plate, so that the nozzle plate is flat and rests sealingly with the nozzle on the free end of the movable valve element (e.g. tappet). In the opened position, on the other hand, the valve drive bends the nozzle plate so that the nozzle is lifted from the free end of the valve element with a certain stroke, so that coating agent can escape from the nozzle. The stroke of the nozzle plate in the area of the nozzle between the closed position and the opened position is preferably about 30 μm.

It was already mentioned briefly at the beginning that the seal can be flat. For example, the seal can have a sealant layer which, for example, is vulcanised onto the nozzle plate, evaporated, applied by a layer-forming process or printed on.

Alternatively, it is also possible for the seal to have a film which can, for example, be glued, laid on, bonded or laminated to the nozzle plate.

With regard to the choice of material within the scope of the disclosure, it should be mentioned that the movable element preferably consists at least partially of metal, plastic or silicon.

Furthermore, the print head according to the disclosure preferably has one of the following material combinations on the nozzle between the side of the valve element and the side of the nozzle:

Metal on metal,
Plastic on metal,
Metal on plastic,
Plastic on silicon,
silicon on silicon, or
Metal on silicon.

For example, the moving valve element can be made of metal and combined with a plastic tappet.

In addition, the orifice may be made of silicon or contain a silicon orifice insert, while the movable valve element is at least partially made of steel, rubber or plastic (e.g. PTFE: polytetrafluoroethylene).

When the movable valve element moves from the opened position to the closed position, the seal usually also forms a mechanical stop which limits the movement of the valve element to the closed position. The seal therefore has two functions: firstly, the actual sealing function and secondly, the function of a mechanical stop.

In another embodiment of the disclosure, a separate mechanical stop is provided to limit the movement of the valve element to the closed position. This can be advantageous because a defined compression force acts on the seal.

The mechanical stop preferably has a material pairing between the side of the valve element and the side of the nozzle, which provides metal on both sides. The seal, on the other hand, is preferably elastic and, in the closed position, undergoes a certain material compression defined by the mechanical stop.

In another embodiment of the disclosure, on the other hand, the movable valve element is preferably designed as a valve plate which can be moved by the valve actuator via a tappet between the opened position and the closed position.

In a variant of the disclosure, the tappet protrudes through the nozzle and the valve plate lies in the closed position on the underside of the nozzle plate facing away from the valve drive. The valve plate is thus pulled into the nozzle to close the nozzle, whereas the nozzle plate is pushed out of the nozzle to open the nozzle.

In another variant, a nozzle channel runs through the nozzle plate from which at least one nozzle is fed. In its closed position, the plate-shaped valve element is in sealing contact with the upper section of the nozzle channel facing the valve drive.

It has already been mentioned above that the print head preferably emits a narrowly limited jet of coating agent in contrast to a spray mist as emitted by conventional atomizers (e.g. rotary atomizers).

It should also be mentioned that the print head can emit a jet of droplets in contrast to a coating agent jet being continuous in the longitudinal direction of the jet. However, within the scope of the disclosure, it is also possible for the print head to emit a coating agent jet that is connected together in the longitudinal direction of the jet, in contrast to a jet of droplets.

In a particular application it may be advantageous to apply high voltage (30-90 kV) to the entire print head or to individual components of the print head (e.g. to the nozzle plate 1) in order to take advantage of the additional benefits of electrostatic painting, such as higher application efficiency and/or electrostatic wrap-around at edges (the charged paint moves along electrical field lines, coating surfaces remote from the applicator near edges).

If electrostatic charging is used, a potential separation system may have to be used in the material supply when processing conductive paints. In this case, all components of the applicator must also be designed to withstand high voltages.

A particular advantage of the print head according to the disclosure is the fact that it works almost free of overspray, i.e. the print head preferably has an application efficiency of at least 80%, 90%, 95% or 99%, so that essentially the entire applied coating agent is completely deposited on the component without overspray forming.

It should also be mentioned that the print head preferably has a large areal coating capacity, so that the print head is also suitable for areal coating in the series painting of vehicle body components. The print head therefore preferably has a surface coating performance rate of at least 0.5 $m^2$/min, 1 $m^2$/min, 2 $m^2$/min or even 3 $m^2$/min.

The print head according to the disclosure can be guided by a multi-axis painting robot, which preferably has serial kinematics with at least six movable robot axes.

FIG. 1 shows a schematic representation of a control valve in an print head according to the disclosure for paint application in a painting line for painting vehicle body components, whereby the print head is moved by a multi-axis painting robot with a standard robot kinematics with at least six robot axes, as it is known from the state of the art and therefore does not need to be described in detail.

The print head according to the disclosure has a nozzle plate 1 with several nozzles 2, whereby only a single nozzle 2 is shown here for simplification.

The paint to be coated is fed from a paint feed 3 in the print head, whereby the paint feed 3 in the drawing is limited at the bottom by the nozzle plate 1 and at the top by a further plate 4.

The upper plate 4 has an opening coaxially to the nozzle 2 in the nozzle plate 1, on which a coil tube 5 is placed coaxially, whereby the coil tube 5 is wound with a coil 6.

In the coil tube 5 there is a coil core 7 which is sealed at the upper end of the coil tube 5 against the coil tube 5 by a seal 8.

In addition, there is an armature 9 in the coil tube 5, which can be moved in the direction of the double arrow, whereby the movement of the armature 9 depends on the current supply to the coil 6.

The drawing shows the armature 9 in a lower closed position to seal the nozzle 2. For paint application, on the other hand, the coil 6 is energized in such a way that the anchor 9 is pulled upwards in the drawing to release the nozzle 2.

In addition, the control valve has a return spring 10 which pushes armature 9 into the closed position shown in the drawing without energising the coil 6.

At its free end, the armature 9 carries a seal 11 to seal the nozzle 2 in the closed position.

The seal 11 on the armature 9 works in the closed position together with a flat seal 12 on the inside of the nozzle plate 1.

In the closed position shown, there is a flat contact between the two seals 11, 12 on the armature 9 on the one hand and on the nozzle plate 1 on the other hand.

The flat seal 12 on the inside of the nozzle plate can, for example, consist of a sealant layer, which is vulcanised onto the inside of the nozzle plate 1, evaporated, applied by a layer-forming process or printed on.

Alternatively, there is the possibility that the seal 12 is a foil which is laid, glued or laminated on the inside of the nozzle plate 1.

Figure 2:
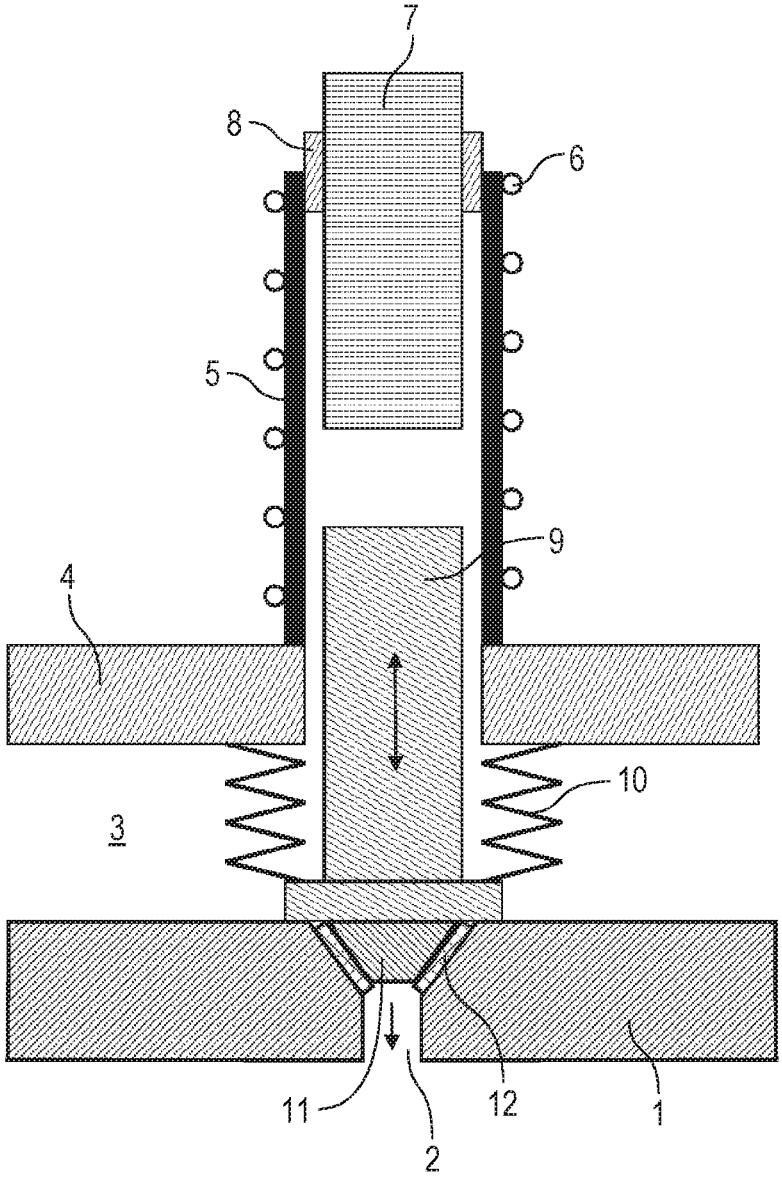

Furthermore, there are various possibilities for the material pairings of the seal 11 on the one hand and the seal 12 on the other hand. For example, metal on metal, plastic on metal, metal on plastic, plastic on silicon, silicon on silicon or metal on silicon can be used as material pairings. FIG. 2 shows a modification of the embodiment according to FIG. 1, so that the above description is referred to in order to avoid repetitions, whereby the same reference signs are used for the corresponding details.

A feature of this embodiment is that the nozzle 2 tapers conically in the inlet area in the direction of flow and has lateral nozzle flanks. The seal 12 is therefore applied to the lateral nozzle flanks of the nozzle 2.

In addition, the seal 11 is adapted to this shape of the nozzle and therefore tapers conically towards its free end, so that the seal 11 on the one hand and the nozzle 2 on the other hand are adapted in shape, which leads to a good sealing effect.

Figure 3:
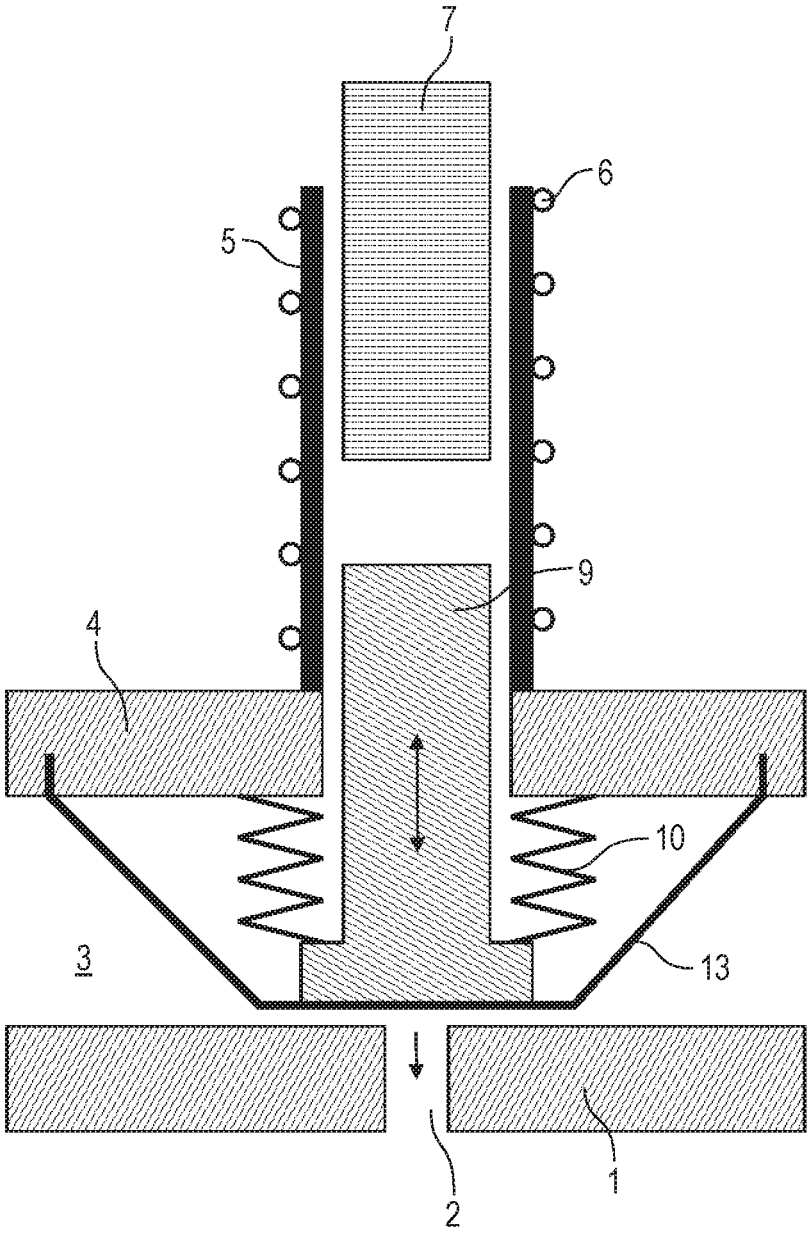

FIG. 3 shows a further modification of the embodiments described above, so that reference is again made to the above description in order to avoid repetitions.

A feature of this embodiment is a flexible sealing diaphragm 13 instead of the seal 11. The drawing shows the opened position in which the armature 9 is raised upwards and the sealing diaphragm 13 releases the nozzle. To close the nozzle 2, however, the coil 6 is disconnected from the power supply so that the armature 9 is pressed downwards by the return spring 10 in the drawing until the sealing diaphragm 13 rests on the internal orifice of the nozzle 2 in the nozzle plate 1 and thus closes the nozzle 2.

The sealing diaphragm 13, however, does not only have the function to release or close the nozzle 2. In many cases, the sealing diaphragm 13 also provides a seal between the paint supply 3 and the other components of the control valve, such as the armature 9, the coil tube 5 and the coil core 7. This is advantageous because it prevents paint deposits in the control valve and in particular in the coil tube 5. This is particularly important when changing the colour, because the control valve itself does not have to be rinsed because it does not come into contact with the paint at all.

Figure 4:
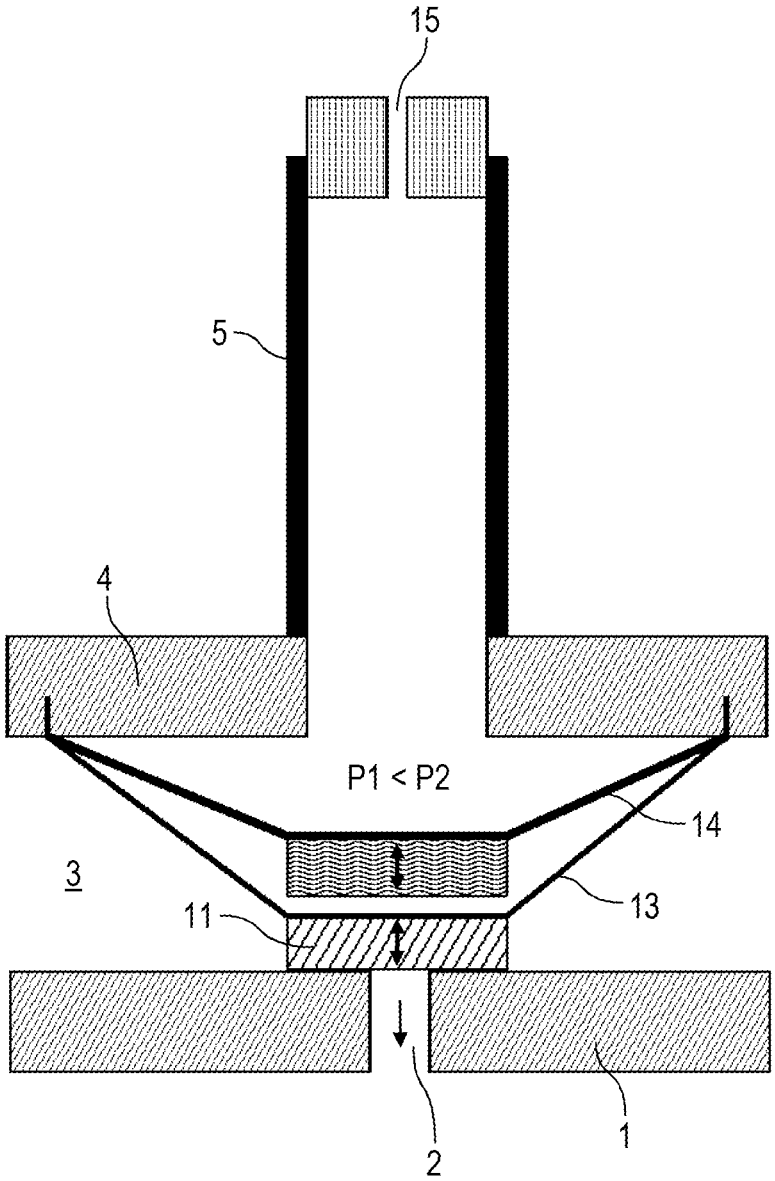

FIG. 4 shows a modification of the embodiment according to FIG. 3, so that the above description is referred to in order to avoid repetitions.

A feature of this embodiment is the design of the valve actuator, which does not work electromagnetically—as in FIG. 3—but hydraulically. For this purpose, the valve actuator has a separate actuator diaphragm 14 which can be supplied with a hydraulic fluid as actuator fluid via a hydraulic connection 15 in order to be able to move the actuator diaphragm 14 and thus also the sealing diaphragm 13 with the seal 11 attached to it in the direction of the double arrow.

The actuator diaphragm 14 and the sealing diaphragm 13 provide a double seal between the hydraulic connection 15 and the nozzle 2. This prevents hydraulic fluid from escaping through nozzle 2 in the event of a malfunction with double certainty.

Figure 5:
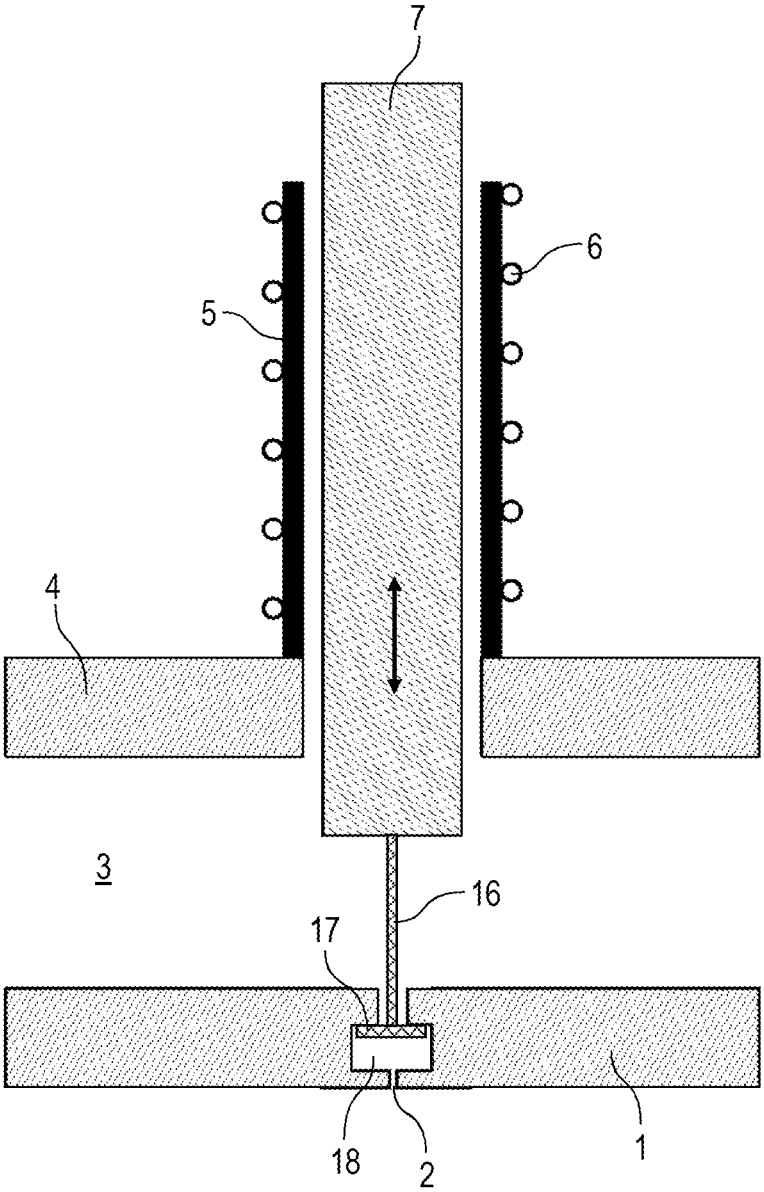

FIG. 5 shows a modification of the embodiment according to FIG. 1, so that reference is made to the above description to avoid repetitions.

A feature of this embodiment is that the return spring 10 has been dispensed with, i.e. the movement of the armature 9 is controlled both in the closed position and in the opened position solely by the current supply to the coil 6.

Another feature is that the armature 9 is connected via a tappet 16 to a valve plate 17, which can be moved in a nozzle channel 18 in the direction of the double arrow. The drawing shows the position of the valve plate 17 in the closed position, in which the valve plate 17 rests against the upper side of the nozzle channel 18 and thus seals the nozzle 2.

To open the nozzle 2, the tappet 16 with the valve plate 17 is pressed downwards in the drawing and then no longer rests against the upper wall of the nozzle channel 18. The paint can then enter the nozzle channel 18 from the paint feed and flow out through the nozzle 2.

Figure 6:
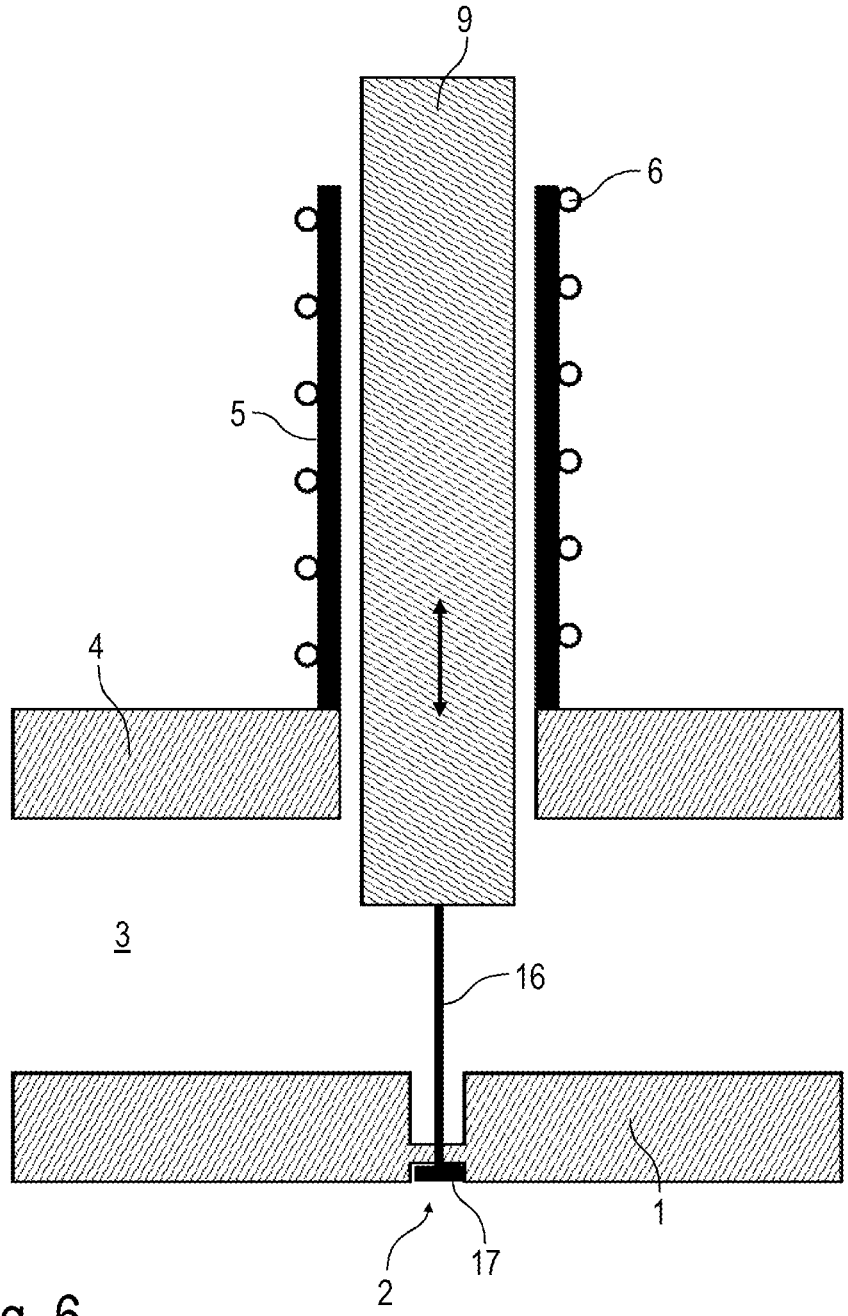
FIG. 6 is a variation of FIG. 5, whereby the valve plate can lie sealingly on the outside of the print head, FIGS. 7A and 7B a variation with a flexible nozzle plate that can be bent to open or close the nozzle, and FIGS. 8A-8C various possible contours of the nozzle in an invented print head.

FIG. 6 shows a modification of the embodiment according to FIG. 5, so that reference is made to the above description to avoid repetitions.

A feature of this embodiment is that no nozzle channel 18 is arranged in the nozzle plate 1. Rather, the valve plate 17, in the closed position shown in the drawing, lies sealingly against the outside of the nozzle plate 1 in a recess.

Figure 7A:
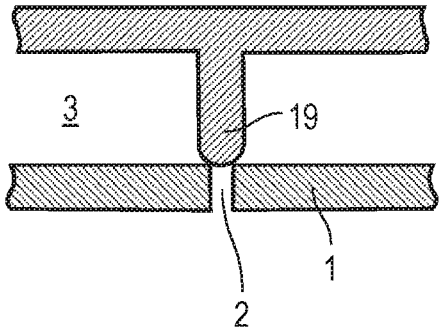
Figure 7B:
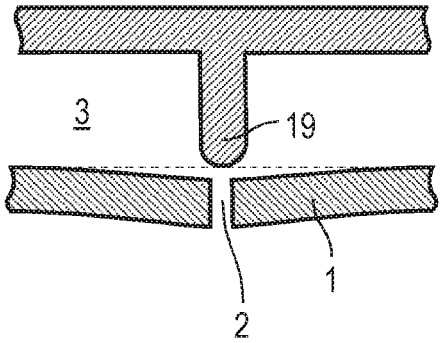

FIGS. 7A and 7B show a different concept for opening and closing the nozzle 2. FIG. 7A shows a closed position, while FIG. 7B shows an opened position in which the nozzle 2 is released.

The nozzle 2 is either sealed or released by a fixed tappet 19. The nozzle plate 1 is either not bent (FIG. 7A) or bent (FIG. 7B) in such a way that the nozzle plate 1 is lifted off the fixed tappet 19 in the area of the nozzle 2. Here it is sufficient if the nozzle plate 1 in the area of the nozzle 2 performs a bending-related stroke of, for example, 30 μm.

Figure 8A:
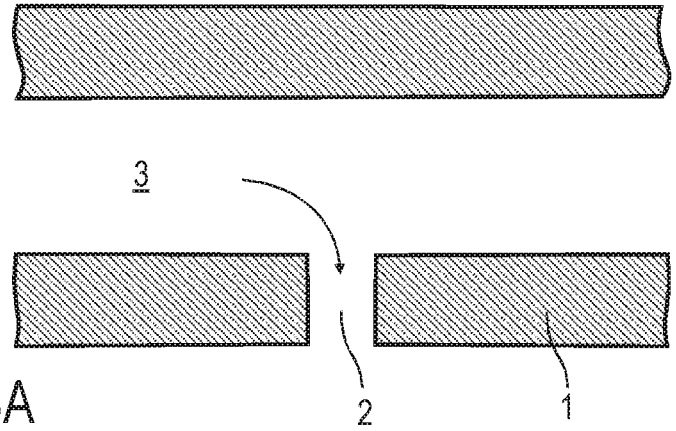
Figure 8B:
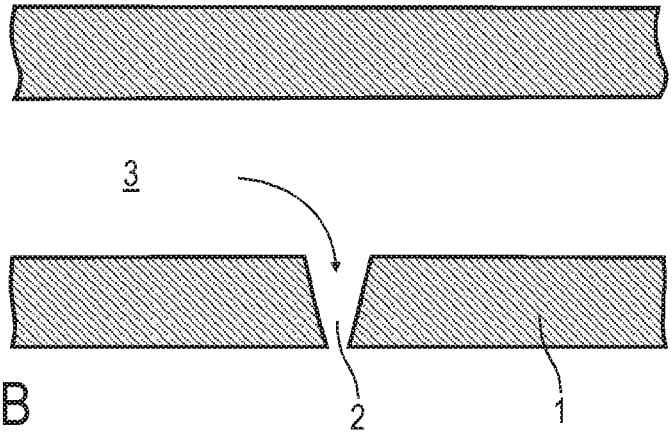
Figure 8C:
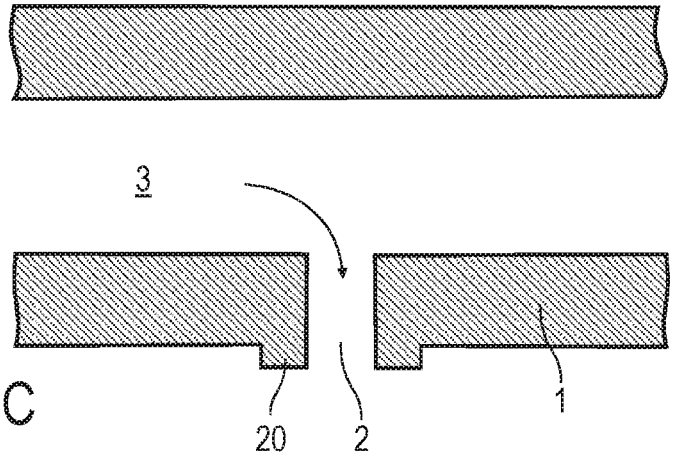

FIGS. 8A-8C show various possible contours of the nozzle 2, namely a cylindrical contour (FIG. 8A), a conic contour (FIG. 8B) and a contour with a raised part 20 on the outlet side of nozzle 2 (FIG. 8C).

LIST OF REFERENCE SIGNS

1 Nozzle plate
2 Nozzle
3 Paint supply
4 Upper plate
5 Coil tube
6 Coil
7 Coil core
8 Seal between coil core and coil tube
9 Armature
10 Return spring
11 Seal on the armature for sealing the nozzle
12 Seal on the nozzle plate to seal the nozzle
13 Sealing diaphragm
14 Actuator diaphragm
15 Hydraulic connection
16 Tappet
17 Valve plate
18 Nozzle channel
19 Tappet
20 Rising on the outside of the nozzle

The invention claimed is:

1. A print head for applying a coating agent to a component comprising:

a) a nozzle plate, b) at least one nozzle in the nozzle plate for dispensing the coating agent, c) a valve element movable relative to the nozzle plate for controlling the release of coating agent through the nozzle, the movable valve element closing the nozzle in a closed position, whereas the movable valve element releases the nozzle in an opened position, d) a flexible drive diaphragm in communication with the valve element, e) a valve drive for moving the valve element between the opened position and the closed position, f) a flexible sealing diaphragm deflectable by the valve drive between the opened position and the closed position, and g) a return spring that presses the valve element toward the closed position.

2. The print head according to claim 1, wherein the movable valve element is adapted in its shape complementarily to the shape of the nozzle and penetrates into the nozzle.

3. The print head according to claim 1, wherein the sealing diaphragm is elastic and presses the valve element into the open position.

4. The print head according to claim 1, wherein flexible drive diaphragm is coupled to the valve element and can be acted upon by a drive fluid, in order to deflect the drive diaphragm and thereby move the valve element.

5. The print head according to claim 4, wherein the drive fluid is selected from a group consisting of hydraulic fluid and compressed air.

6. The print head according to claim 4, wherein the drive fluid is the coating agent.

7. The print head according to claim 4, wherein the drive diaphragm and the sealing diaphragm form a double seal between the nozzle and the drive fluid.

8. The print head according to claim 1, wherein the movable valve element at least partially consists of metal.

9. The print head according to claim 1, wherein the following material pairing is provided on the nozzle between the side of the valve element and the side of the nozzle: metal on metal.

10. The print head according to claim 1, wherein the following material pairing is provided on the nozzle between the side of the valve element and the side of the nozzle: plastic on metal.

11. The print head according to claim 1, wherein the following material pairing is provided on the nozzle between the side of the valve element and the side of the nozzle: metal on plastic.

12. The print head according to claim 1, wherein the following material pairing is provided on the nozzle between the side of the valve element and the side of the nozzle: plastic on silicon.

13. The print head according to claim 1, wherein the following material pairing is provided on the nozzle between the side of the valve element and the side of the nozzle: silicon on silicon.

14. The print head according to claim 1, wherein the following material pairing is provided on the nozzle between the side of the valve element and the side of the nozzle: metal on silicon.

15. The print head according to claim 1, wherein the valve element is made of metal and the valve drive for moving the valve element has a valve tappet made of a plastics material.

16. The print head according to claim 1, wherein the nozzle consists of silicon or contains a nozzle insert of silicon, while the movable valve element consists at least partially of steel, rubber or plastic.

17. The print head of claim 1, wherein the flexible sealing diaphragm provides a seal between the valve element and a paint supply.

18. The print head of claim of claim 17, wherein the valve element is an armature.

19. A print head for applying a coating agent to a component comprising:

a) a nozzle plate, b) at least one nozzle in the nozzle plate for dispensing the coating agent, c) a valve element movable relative to the nozzle plate for controlling the release of coating agent through the nozzle, the movable valve element closing the nozzle in a closed position, whereas the movable valve element releases the nozzle in an opened position, d) a valve drive for moving the valve element between the opened position and the closed position, and e) a seal for sealing the nozzle relative to the movable valve element in the closed position of the valve element, e) wherein the seal is not formed as an elastomer insert on the valve element, f) the valve element is plate-shaped and can be displaced by the valve drive, and g) in the closed position, the valve element rests on an underside of the nozzle plate remote from the valve drive, or h) a nozzle channel, in which the valve element can be displaced, runs in the nozzle plate, the valve element in its closed position bearing sealingly against an upper section of the nozzle channel facing the valve drive.

20. The print head according to claim 19, wherein the seal has a sealant layer, which is applied to the nozzle plate.

21. The print head according to claim 19, wherein the seal has a foil which is applied to the nozzle plate.

22. The print head according to claim 19, wherein the print head has a surface coating performance rate of at least 0.5 $m^2$/min.

23. The print head according to claim 19, wherein the print head has at least one electrically controllable actuator for ejecting drops of the coating agent from the print head.

24. A print head for applying a coating agent to a component comprising:

a) a valve element fixedly arranged in the print head, b) an elastically flexible nozzle plate, the nozzle plate having at least one nozzle for dispensing the coating agent, the nozzle movable relative to the valve element for controlling the release of coating agent through the nozzle, the movable nozzle plate closing the nozzle in a closed position, whereas the movable nozzle plate releases the nozzle in an opened position, c) a seal for sealing the nozzle relative to the valve element in the closed position, d) a valve drive for moving the nozzle plate between the opened position and the closed position, e) wherein the valve drive, in the opened position, presses the nozzle plate away from the valve element and thereby releases the nozzle, and whereas, in the closed position, the nozzle plate is in an unbent rest position, in which the valve element closes the nozzle.

25. The print head according to claim 24, wherein the nozzle plate defines a stroke of ±10 μm between the closed position and the opened position.

* * * * *